US006584804B1

(12) United States Patent
Freedman et al.

(10) Patent No.: US 6,584,804 B1
(45) Date of Patent: Jul. 1, 2003

(54) SECURE DISPLAY SETTING FOR A GEMSTONE

(75) Inventors: Maurice N. Freedman, Huntington, NY (US); Stephen L. Guthartz, Huntington, NY (US); Justin B. Freedman, Huntington, NY (US); Steven M. DiRaimo, Woodbury, NY (US)

(73) Assignee: Volare, LLC, Huntington, NY (US)

( * ) Notice: Subject to any disclaimer, the term of this patent is extended or adjusted under 35 U.S.C. 154(b) by 2 days.

(21) Appl. No.: 09/760,548

(22) Filed: Jan. 16, 2001

Related U.S. Application Data

(60) Provisional application No. 60/176,473, filed on Jan. 17, 2000.

(51) Int. Cl.[7] ..... A44C 17/02
(52) U.S. Cl. ..... 63/26; 63/29.1
(58) Field of Search ..... 63/26, 28, 29.1, 63/30, 31

(56) References Cited

U.S. PATENT DOCUMENTS 248,785 A * 10/1881 Pardee ..... 63/26
1,712,171 A * 5/1929 Rochas ..... 63/26
2,835,117 A * 5/1958 Lutrario ..... 63/26
4,216,567 A 8/1980 Heinz
4,435,963 A 3/1984 Shigeru
4,485,916 A * 12/1984 Krejcik ..... 206/45.34
4,488,415 A * 12/1984 Jenkins ..... 63/29 R
4,982,581 A 1/1991 Furuyama
5,077,989 A 1/1992 Dillabaugh
5,456,095 A 10/1995 Tawil et al.
5,992,177 A * 11/1999 Beard ..... 63/29.1
6,324,869 B1 * 12/2001 Vanlioglu ..... 63/31

* cited by examiner

*Primary Examiner*—J. J. Swann
*Assistant Examiner*—André L. Jackson
(74) *Attorney, Agent, or Firm*—Woodard, Emhardt, Moriarty, McNett & Henry LLP

(57) ABSTRACT

A secure display setting and a method of doing business using the secure display setting are provided. A display setting including a base portion with a lower barrel may be lockingly secured to an upper portion including an upper barrel and prongs with a gemstone located therebetween. A spring is used to bias the gemstone against the prongs. In certain forms of the invention, the gemstone can not be removed from the display setting without causing obvious damage to the display setting. The value of the gemstone is maintained or secured by the seller if the potential customer returns the display setting with obvious damage.

4 Claims, 8 Drawing Sheets

SECURE DISPLAY SETTING FOR A GEMSTONE

CROSS-REFERENCE TO RELATED APPLICATIONS

The present application claims the benefit of U.S. Provisional Application Ser. No. 60/176,473 filed Jan. 17, 2000.

BACKGROUND OF THE INVENTIONS

The present invention relates generally to a secure display setting for a gemstone, and more particularly to a secure display setting that will provide a means for identifying an individual gemstone provided to a potential customer for evaluation.

In the gem industry, loose stones are commonly sent to buyers for evaluation. Similarly, loose gemstones are shown to potential buyers in shops. In these situations, it is possible that the potential customer will attempt to substitute another gemstone of lesser value for the original gemstone provided. There is a need for a secure display setting for a gemstone to aid in identifying whether the loose stone returned by the potential customer is the same stone provided to that customer.

The present invention is directed toward meeting the above need, among others.

SUMMARY OF THE INVENTIONS

The present inventions relate to a secure display setting for a gemstone which is used to identify an individual gemstone as the stone previously provided to a potential customer. In at least one embodiment of the present inventions, a tamper evident desplay setting for a gemstone is provided.

Other objects and advantages of the present invention will be apparent from the following description of the preferred embodiments.

DESCRIPTION OF THE PREFERRED EMBODIMENTS

Figure 1:
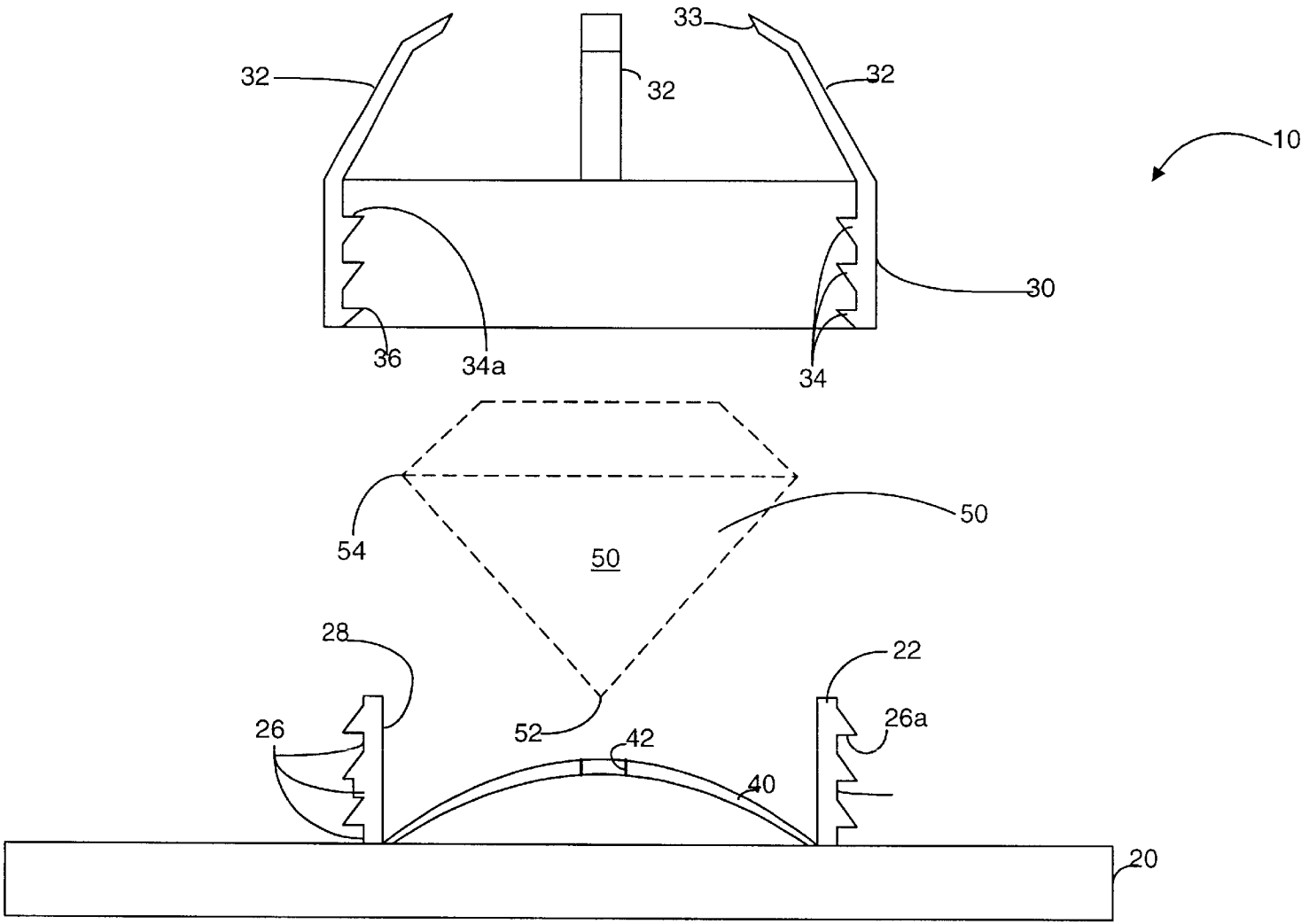
FIG. 1 is an exploded side cross-sectional view of a secure display setting for a gemstone, in accordance with an embodiment of the present inventions.

For the purposes of promoting an understanding of the principles of the inventions, reference will now be made to the embodiments illustrated in the drawings and specific language will be used to describe the same. Like reference numbers designate like or corresponding parts throughout the drawings and specification. It will nevertheless be understood that no limitation of the scope of the inventions is thereby intended. Any such alterations and further modifications in the illustrated device, and any such further applications of the principles of the invention as illustrated therein are contemplated-herein as would normally occur to one skilled in the art to which the inventions relate.

Figure 2:
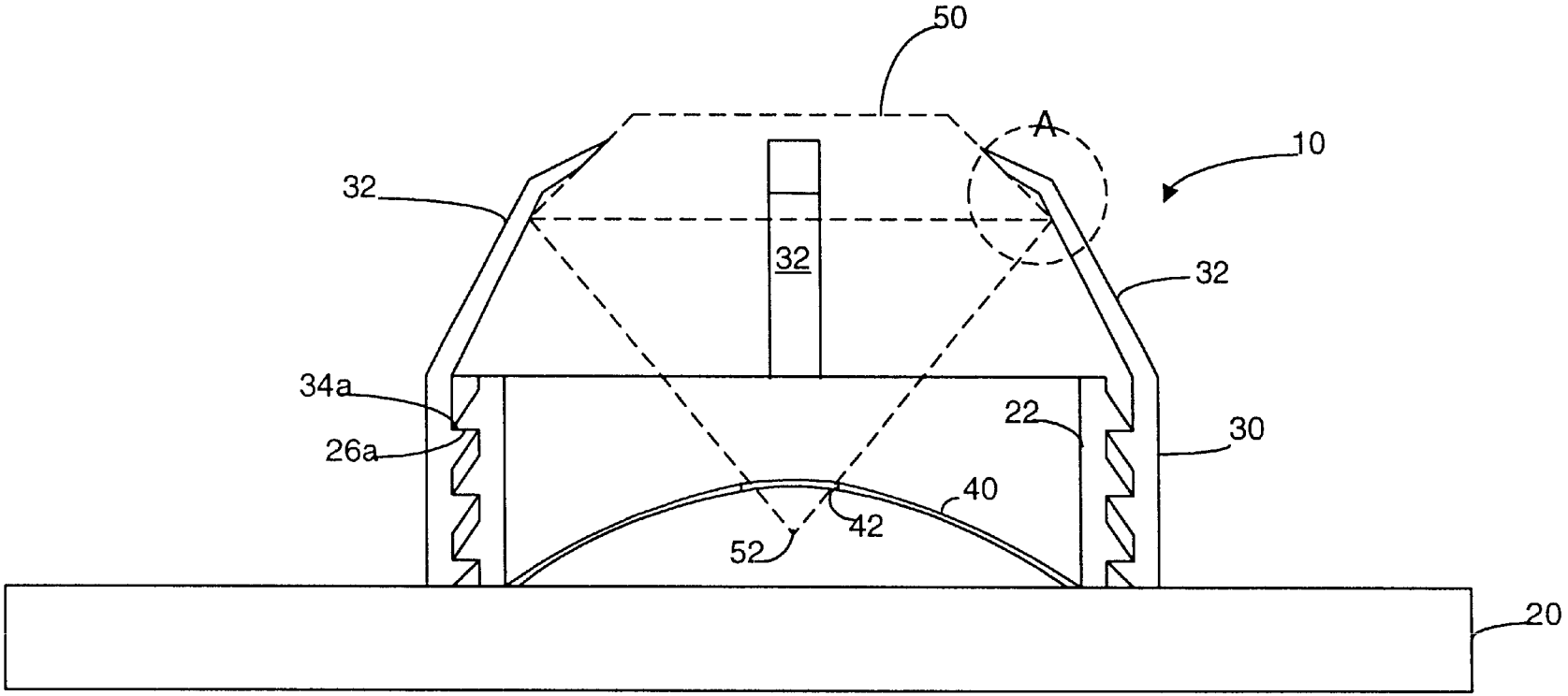
FIG. 2 is a side cross-sectional view of a secure display setting for a gemstone, in accordance with an embodiment of the present inventions.
Figure 3:
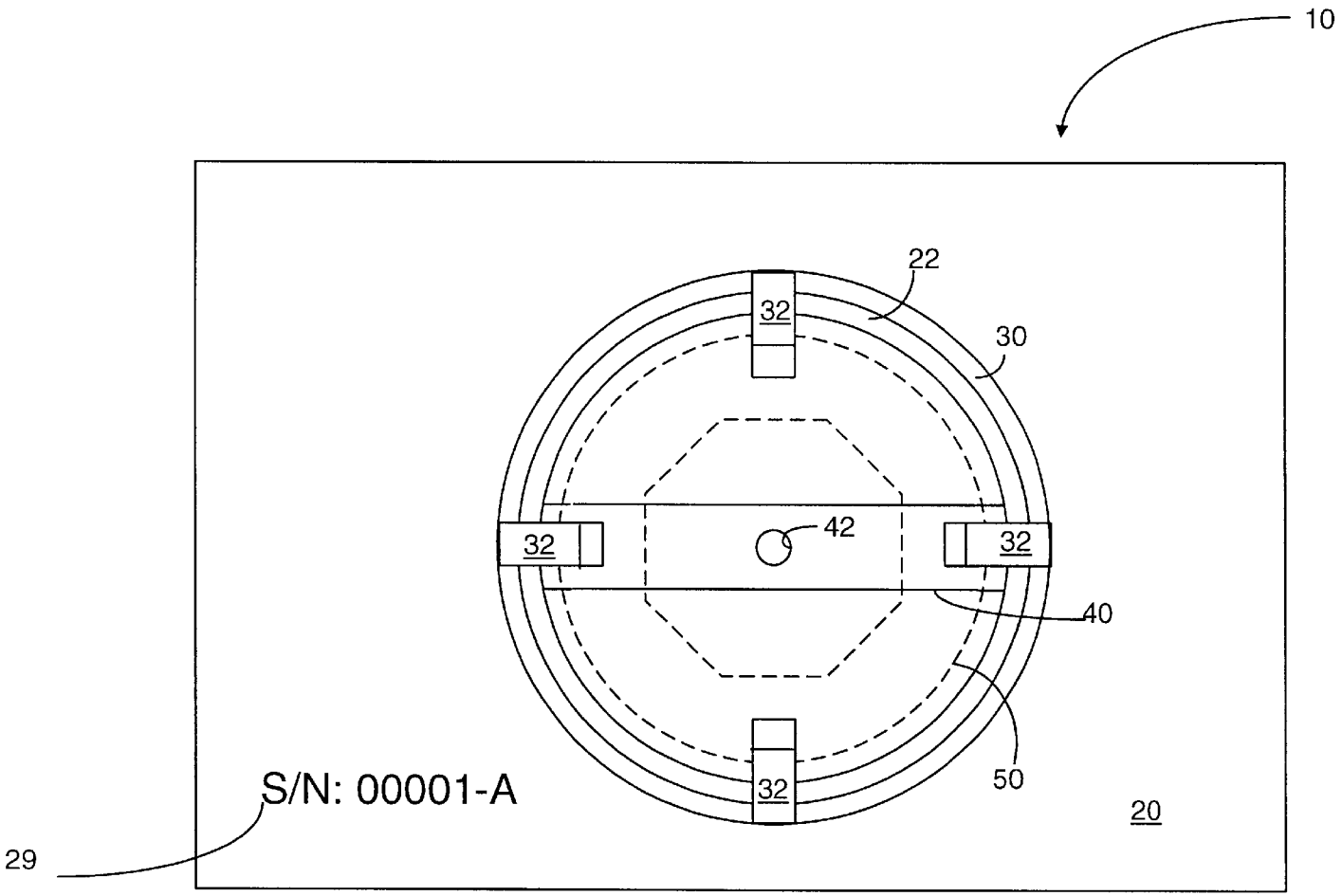
FIG. 3 is a top view of a secure display setting for a gemstone and said gemstone, in accordance with an embodiment of the present inventions.

Now more particularly describing a first embodiment of the present inventions, there is a secure display setting for a gemstone, as follows. Referring now to FIGS. 1–3, there is shown display setting 10 for the secure display of a gemstone. Display setting 10 includes a base portion 20 and a locking upper portion (or upper barrel) 30. When assembled, a leaf spring 40 is used to bias a gemstone 50 against the prongs 32 of the upper barrel 30. The leaf spring 40 includes a hole 42, therethrough, to center the gemstone when the point, or culet 52 of the stone is centered in the hole 42. Alternatively, a coil spring may be used instead of the leaf spring 40, wherein the culet 52 is centered in the hole through the coil spring. Such a leaf spring 40 (or coil spring) would be chosen to have sufficient spring force to maintain the gemstone in contact with the prongs 32.

Base portion 20 of display setting 10, includes a lower locking portion (or lower barrel) 22. Lower barrel 22 includes an outer surface 24 and an inner surface 28. Outer surface 24 includes means to lock the lower barrel to the upper barrel. In the present embodiment, lower barrel 22 includes locking grooves 26, which, when assembled with the upper barrel 30, mate with unidirectional ridges 34 present in the inner wall 36 of the upper barrel 30. As such, upper barrel 30 may be easily slid over the lower barrel 22 to mate the two pieces. However, once assembled, a top surface 34*a* of the unidirectional ridge 34 will contact an abutment surface 26*a* in locking groove 26, to prevents the upper barrel 30 from being unmated with the lower barrel 22.

Unidirectional ridges 34 and grooves 26 may be integrally formed with the upper and lower barrels, may be machined on the upper and lower barrels, or may be produced on the upper and lower barrels using other known methods. Additionally, although three unidirectional ridges 34 are shown, this is not meant to be limiting, as more or fewer locking members may be used, if desired. Additionally, other forms of locking mechanisms, such as tongue and groove fasteners, etc., may be used.

Preferably, once assembled, the locking mechanism chosen will not permit the easy disassembly of the display setting 10, without damaging the display setting 10 in some way (i.e. breaking the prongs, showing evident stress or fracture marks in the material of the prongs and/or upper barrel, etc.). More preferably, the upper and lower barrels will securely mate such that the gemstone can be removed only by breaking one of the prongs 32 or damaging the upper and/or lower barrels. Additionally, if desired, an epoxy or other adhesive material, or heat bonding may be used to further lock the upper and lower barrels.

In an alternative embodiment not shown, the upper and lower barrels of the display setting would not include distinct locking members, as described in connection with the above embodiment, but may be locked together securely using epoxy or other adhesive material. Similarly, the upper and lower barrels could be heated bonded together to maintain a locking seal.

Figure 2A:
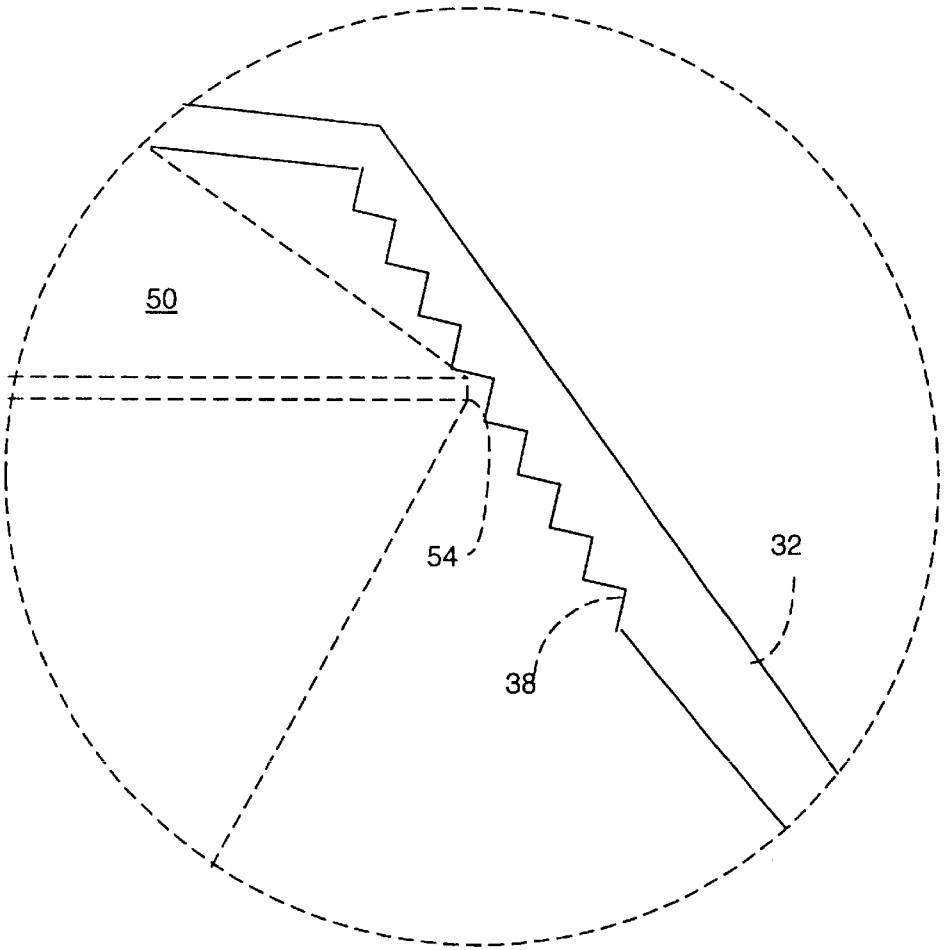
FIG. 2A is an enlarged view of a portion of the secure display setting for a gemstone of FIG. 2.

Referring back to the embodiment of FIGS. 1–3, the inner surface diameter of the upper barrel 30 shall be chosen to be larger than the diameter of the gemstone across the girdle 54. As such, the gemstone 50 may be passed through the inner opening of the upper barrel 30, to rest against the prongs 32. Additionally, referring specifically to FIG. 2A, in the present embodiment, the prong 32 may include a plurality of ridges 38, that contact the gemstone 50 at the girdle 54, to further stabilize the gemstone in the display setting. The use of a plurality of ridges on the inner surface of the prongs 32 permits gemstones of different sizes to be stabilized in the display setting 10. If desired, the angle of the prong 32 be chosen such that the tip surface 33 of the prong 32 rests against the crown of the gemstone to further stabilize the gemstone in the display setting 10, as shown in FIG. 2.

To assist in identifying the particular gemstone, if desired, the base 20 of the display setting 10, may include a serial number or other identifying mark thereon, such as serial number 29 of FIG. 3. Additionally, although the embodiment of FIGS. 1–3 is shown having the lower barrel 22 on a slab type base, the lower barrel may be secured to or formed on other types of bases, such as the inner surface of a jewelry box, or a display case.

Figure 4:
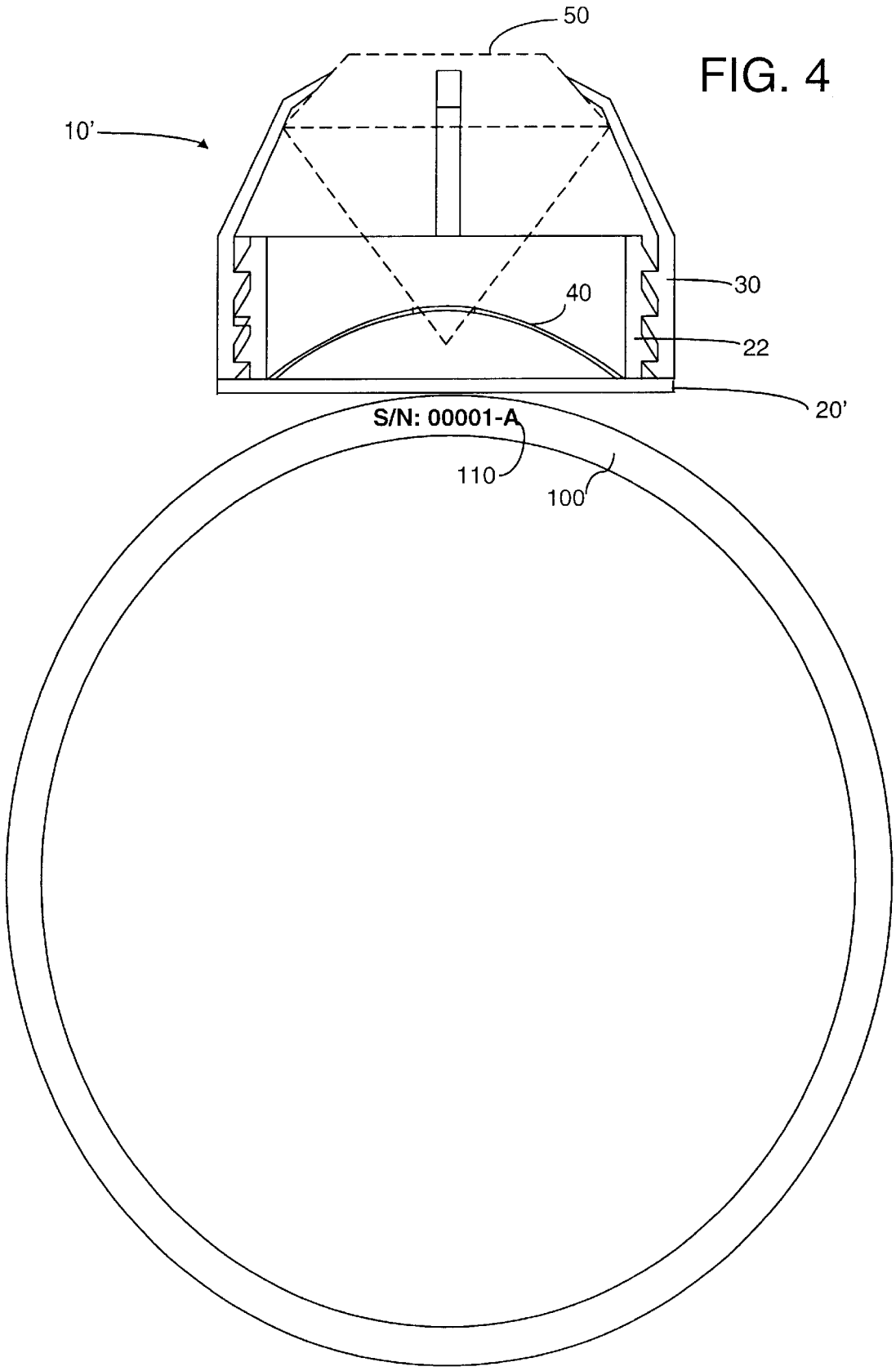
FIG. 4 is a side cross-sectional view of a secure display setting for a gemstone, in accordance with an embodiment of the present inventions.

Referring now to FIG. 4, there is shown another embodiment of the present inventions, wherein the display setting 10' is made in the form of a ring, such that potential buyers of the loose stone can display the stone in a more familiar type of setting. The display setting 10' is shown as being substantially of the type shown in FIGS. 1–3 but wherein, the base 20' is adapted to be bonded to the surface of the ring 100, and wherein the serial number 110 is placed on the ring portion instead of, or in addition to, being placed on the base 20' or upper barrel 30. The locking mechanism of the embodiment of FIG. 4, may be any of those described above, including securing the upper and lower barrel using an adhesive material. Preferably, for optimum security, a unidirectional locking device, such as is shown in FIGS. 1–3 should be used instead of or in addition to a locking adhesive.

In one tamper evident embodiment of the present inventions, such as those shown in FIGS. 1–4, wherein locking ridges are used to secure the upper and lower barrels, the upper barrel 30 should be chosen of a material flexible enough to permit the upper barrel to slide over the lower barrel and mate therewith, but be of rigid and/or brittle enough material to not permit removal of the upper barrel from the lower barrel without causing evident damage to the upper barrel. Similarly, the material of prongs 32 may be a rigid, brittle and/or substantially unmaleable material, such as hard plastic or very brittle metal, that would break if a prong 32 were to be bent away from the gemstone with a force great enough to lift the prong away from the surface of the spring biased gemstone. This force necessary to break or damage the prongs would obviously be greater than the spring force biasing the gemstone against the prongs. If desired, the upper portion including the upper barrel may be made of a different material than the base and/or lower barrel.

Figure 7:
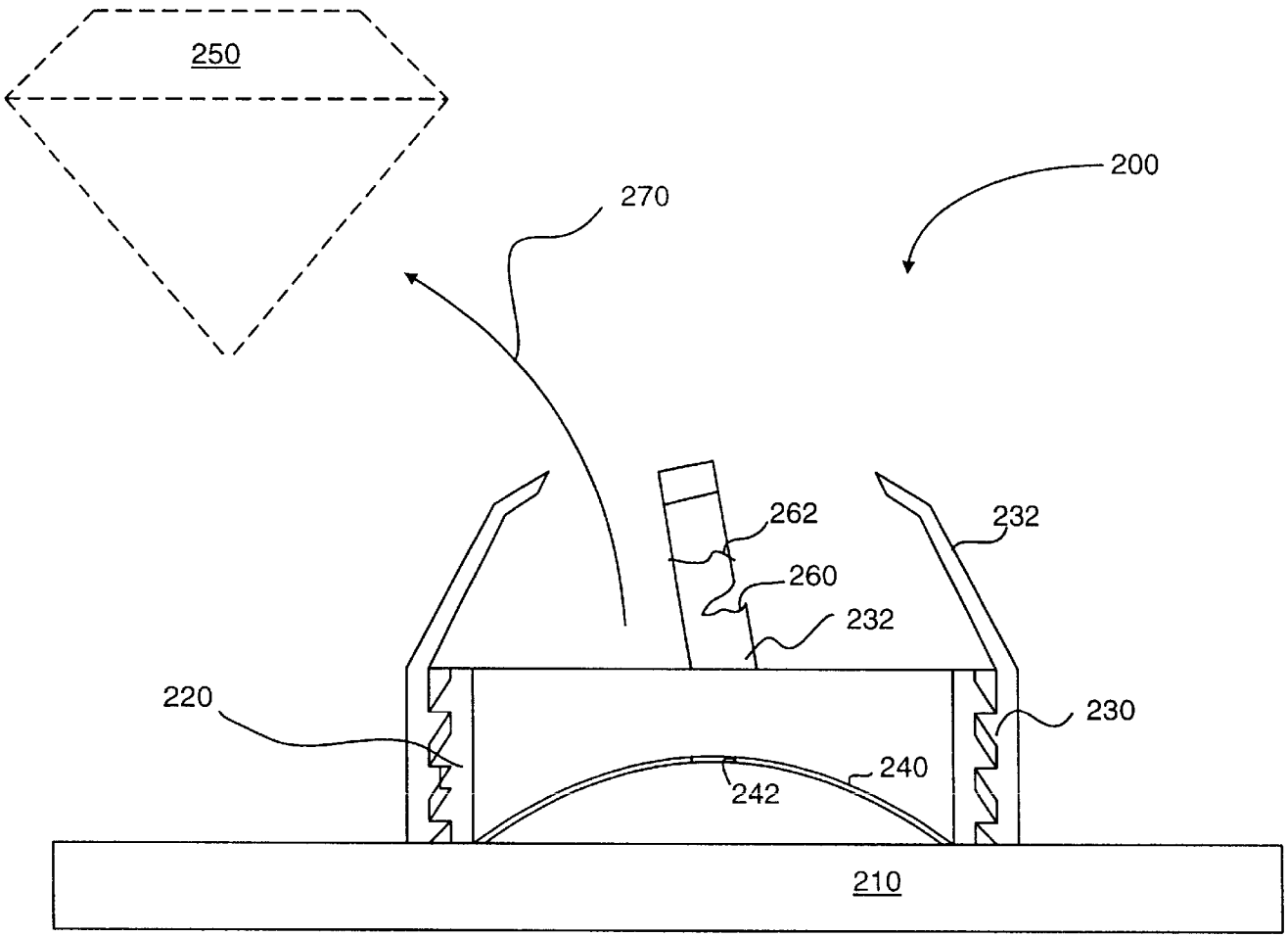
FIG. 7 is a side cross-sectional view of a tamper evident embodiment of the present inventions.

Alternatively, the upper barrel and/or prongs may be made of a very thin plastic material, which is easily torn, such that if it is attempted to remove the upper barrel from the lower barrel, or the gemstone from the display setting, stress marks or tears will be evident in the fragile plastic of the upper barrel and/or prongs. For example, referring now to FIG.7, there is shown a display setting 200 wherein the gemstone 50 has been removed from the thin plastic upper barrel 230. In such a case, if another stone were to be substituted for stone 50, tear 260 and stress mark 262 would evidence that prong 232 had been tampered with.

In one method of transacting business using the present secure display setting, the salesman may debit the potential customer's account or charge the cost of the stone to the customer's charge card in advance of providing the stone to the potential customer with the understanding, express or implied, that the debit or charge will be re-credited if the display setting is returned untampered with. After debiting the account or charging the card, the loose stone is placed in a secure locking display setting of the types described in the above embodiments, i.e. a display setting as described in connection with FIGS. 1–4. If the display setting is returned to the salesman with obvious damage to the upper barrel or one or more prong, or other signs of tampering, the salesman will not re-credit the money advanced by the potential customer to examine the stone. If the display setting is returned with no evident damage, the salesman will re-credit the potential customer for successfully returning the stone.

In an alternative method of transacting business, the potential customer and salesman may arrange for debiting the customer's account or charge card, at the time the stone is returned, if the display setting shows evidence of tampering. This alternative method differs from that above in that the customer is charged after the fact for the tampered with gemstone. Where the first described business method is more useful if the stone is being sent to a remote location, the present method is more useful if the gemstone is examined at a point of sale location, such as the salesman's shop.

Figure 5:
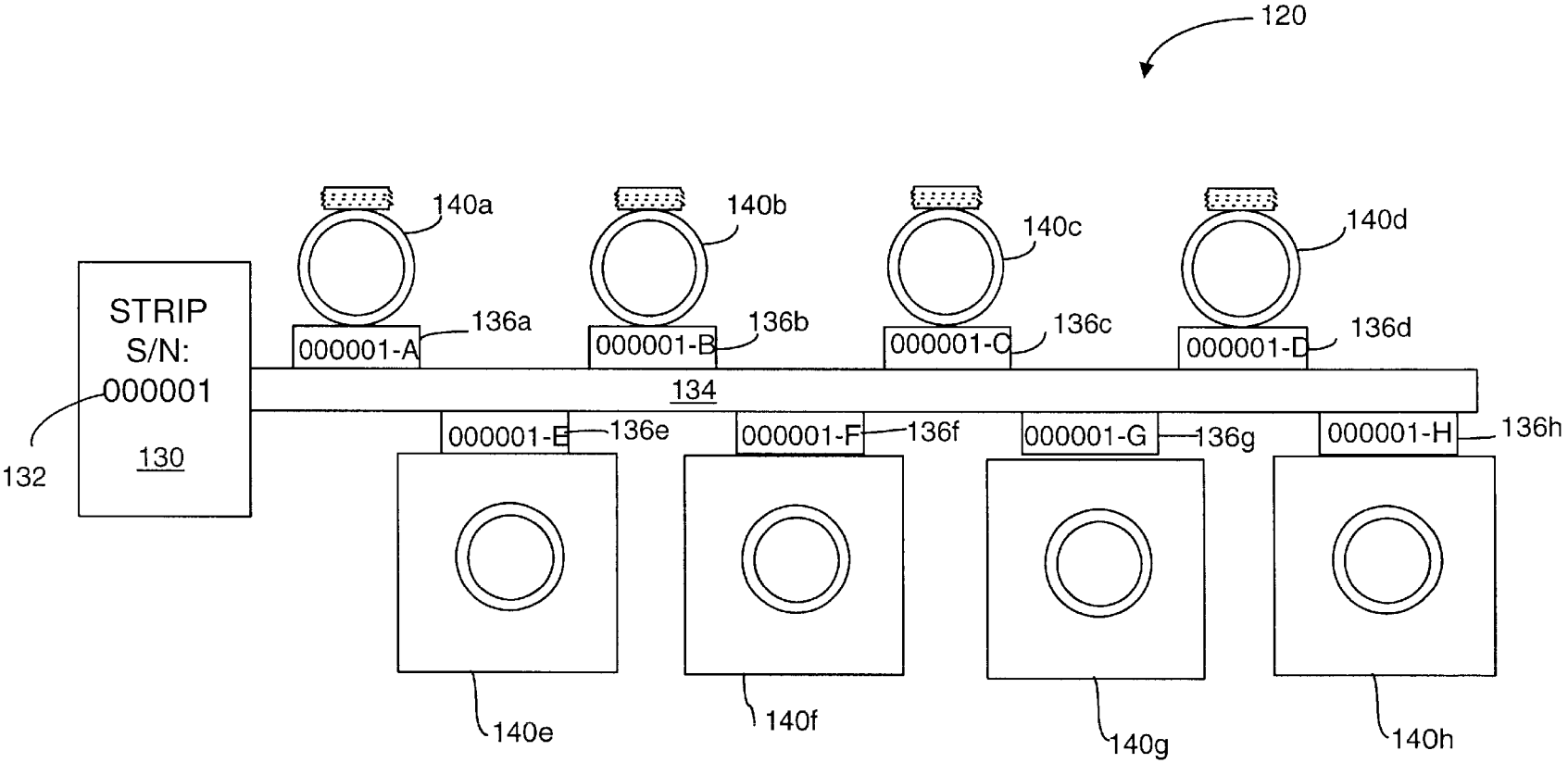
FIG. 5 is a top elevational view of a strip of prefabricated display device portions in accordance with an embodiment of the present invention.

In one embodiment of the present inventions, the base portions of the display settings of FIGS. 1–4, may be molded using known plastic molding techniques. Referring now to FIG. 5, there is shown a molded strip 120, including an identifier block 130 and a strip portion 134. Formed on strip 134 using a molding process are base portions 140*a*–140*h*. For purposes of example, molded strip 120 is shown as having base portions 140*a*–140*d* of the type described in connection with FIG. 4 and base portions 140*e*–140*h* of the type described in connection with FIGS. 1–3. This is not meant to be limiting, as the molded base portions may be a formed all of one type, or even of different types from those shown.

During the molding process, an identifying mark or serial number may also be formed as part of the strip 134 on strip tags 134*a*–134*h*, to which the base portions 140*a* –140*h* are formed, respectively, at a break point. The identifying marks may be formed in the plastic of the strip tag, and correspondingly, the base portions, as part of the molding process, or may be stamped in while the plastic is still soft. Once the plastic has cooled, the base portions 140*a*–140*h* may be snapped off the strip 134 at the break points and used.

Figure 6:
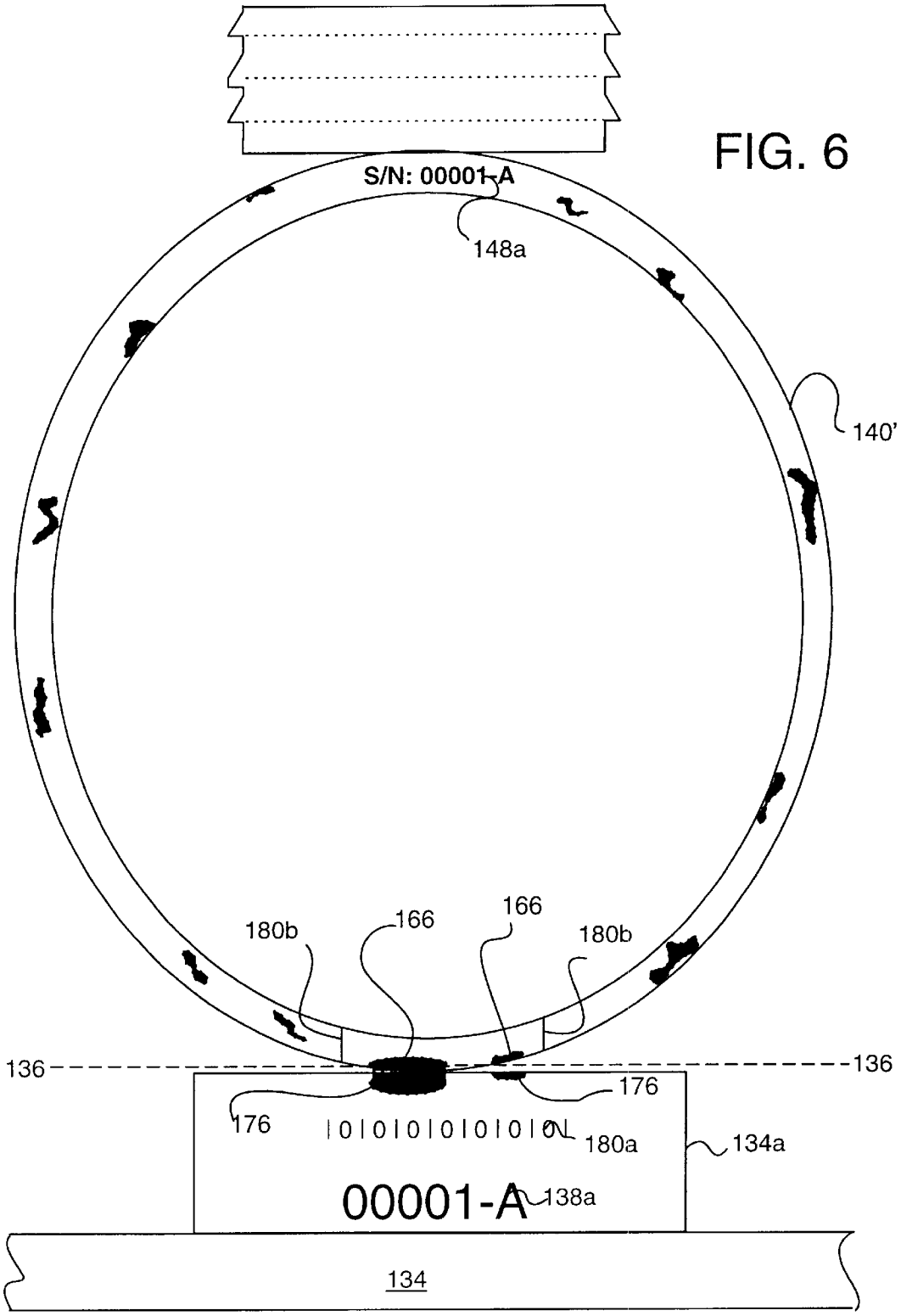
FIG. 6 is a side elevational view of a prefabricated display device portion in accordance with an embodiment of the present inventions.

Referring now to FIG. 6, as a further measure of identification, in a system where the base portions are formed using the molding process described in connection with FIG. 5, a secondary color of plastic may be injected randomly into the mold with the primary color of plastic. This injection will cause a random distribution of the secondary color of plastic to be molded into the base portion, as well as the strip tag. The secondary color distribution 166 on the base portion should match that of the secondary color 176 on the strip tag at the break point 136. If desired, an alignment scale, such as scale 180*a* may be formed on the strip tag, with corresponding alignment marks 180*b* being formed in the base portion 140'. As such, if the molding strips are retained, a further measure of security is provided when the display setting is returned by matching the base portion serial number 148*a* to the strip tag with the same serial number 138*a*, and comparing the alignment of the secondary color patterns. Even if the serial numbers match, if the secondary color patterns do not match, the salesman can determine that a different base portion (and correspondingly, a different gemstone) has been substituted for the display setting sent to the customer. If the salesman so determines that the setting has been substituted with another, or otherwise tampered with, the customer's account or charge card can be automatically debited or not re-credited, in accordance with one of the above described business methods.

While the invention has been illustrated and described in detail in the drawings and foregoing description, the same is to be considered as illustrative and not restrictive in character. It being understood that only the preferred embodiments have been shown and described and that all changes and modifications that come within the spirit of the invention are desired to be protected.

What is claimed is:

1. A secure display setting for a gemstone, comprising:

a base portion including a lower barrel:

an upper portion including an upper barrel and at least one prong, said upper barrel including a distal and a proximal end, the distal end being sized to receive the gemstone therethrough, said at least one prong being located at the proximal end;

means for locking said upper barrel with said lower barrel securely;

a spring located in said lower barrel; and wherein said spring biases the gemstone against said prong when said upper barrel is locked with said lower barrel with the gemstone located within said upper and lower barrel between said spring and said prong, wherein at least one of said upper barrel and said prong comprise a rigid material, wherein a force applied to said upper barrel sufficient to decouple said upper barrel from said lower barrel when said upper barrel is locked to said lower barrel will cause damage to-said rigid material.

2. The secure display setting for a gemstone of claim 1, wherein said means for locking includes a mechanical locking device comprising at least two locking portions, said upper barrel including a first locking part, said lower barrel including a second locking part, complementary with said first locking part.

3. A secure display setting for a gemstone, comprising:

a base portion including a lower barrel:

an upper portion including an upper barrel and at least one prong, said upper barrel including a distal and a proximal end, the distal end being sized to receive the gemstone therethrough, said at least one prong being located at the proximal end;

means for locking said upper barrel with said lower barrel securely;

a spring located in said lower barrel; and wherein said spring biases the gemstone against said prong when said upper barrel is locked with said lower barrel with the gemstone located within said upper and lower barrel between said spring and said prong, wherein at least one of said upper barrel and said prong comprise a rigid material, wherein a force applied to said prong sufficient to permit removal of the spring biased gemstone from under said prong will cause damage to said rigid material.

4. The secure display setting for a gemstone of claim 3, wherein said means for locking includes a mechanical locking device comprising at least two locking portions, said upper barrel including a first locking part, said lower barrel including a second locking portion, complementary with said first locking portion.

* * * * *